US012385324B2

(12) United States Patent
Belnap

(10) Patent No.: US 12,385,324 B2
(45) Date of Patent: Aug. 12, 2025

(54) TWO-STAGE DRILL BIT

(71) Applicant: Schlumberger Technology Corporation, Sugar Land, TX (US)

(72) Inventor: J. Daniel Belnap, Lindon, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/501,520

(22) Filed: Nov. 3, 2023

(65) Prior Publication Data

US 2025/0146365 A1 May 8, 2025

(51) Int. Cl.

| | |
|---|---|
| ***E21B 10/43*** | (2006.01) |
| ***E21B 10/08*** | (2006.01) |
| ***E21B 10/62*** | (2006.01) |

(52) U.S. Cl.

CPC ..... *E21B 10/43* (2013.01); *E21B 10/08* (2013.01); *E21B 10/62* (2013.01)

(58) Field of Classification Search

CPC ..... E21B 10/08; E21B 10/62; E21B 10/43

See application file for complete search history.

(56) References Cited

U.S. PATENT DOCUMENTS

| | | | | |
|---|---|---|---|---|
| 3,126,973 | A * | 3/1964 | Kiel | E21B 10/16 175/378 |
| 2010/0089648 | A1* | 4/2010 | Hall | E21B 10/5673 175/428 |
| 2016/0273273 | A1 | 9/2016 | Hinz | |
| 2019/0078392 | A1* | 3/2019 | Boehm | E21B 10/573 |
| 2021/0254410 | A1* | 8/2021 | Maouche | E21B 10/43 |

* cited by examiner

*Primary Examiner* — Kristyn A Hall

(74) *Attorney, Agent, or Firm* — Jeffrey D. Frantz

(57) ABSTRACT

A device may include a bit body with a rotational axis in a longitudinal direction. A device may include at least one blade coupled to the bit body with an outward surface. A device may include a rolling cutting element positioned on the outward surface. A device may include a fixed cutting element positioned with a fixed cutting profile at least partially rotationally overlapping with a rolling cutting profile of the rolling cutting element.

20 Claims, 9 Drawing Sheets

TWO-STAGE DRILL BIT

BACKGROUND

Conventional drag bits used to drill in an earth formation use a plurality of fixed cutting elements to scrape and fracture rock and other material in the downhole environment. The depth of cut of the drill bit is limited by the torque and weight that can be applied to the bit while maintaining safe operating conditions for the drill bit and the drilling system.

SUMMARY

In some aspects, the techniques described herein relate to a drill bit including: a bit body with a rotational axis in a longitudinal direction; at least one blade coupled to the bit body with an outward surface; a rolling cutting element positioned on the outward surface; and a fixed cutting element positioned with a fixed cutting profile at least partially rotationally overlapping with a rolling cutting profile of the rolling cutting element.

In some aspects, the techniques described herein relate to a drill bit including: a bit body with a rotational axis in a longitudinal direction; a first blade coupled to the bit body with a first outward surface; a first rolling cutting element having a cutting element axis in plane with a first radial plane of the rotational axis positioned on the first outward surface; a first fixed cutting element positioned with a first fixed cutting profile at least partially rotationally overlapping with a first rolling cutting profile of the first rolling cutting element; a second blade coupled to the bit body with a second outward surface; a second rolling cutting element having a cutting element axis in plane with a second radial plane of the rotational axis positioned on the second outward surface; and a second fixed cutting element positioned with a second fixed cutting profile at least partially rotationally overlapping with a second rolling cutting profile of the second rolling cutting element, wherein the first rolling cutting profile rotationally overlaps the second rolling cutting profile.

In some aspects, the techniques described herein relate to a drill bit including: a bit body with a rotational axis in a longitudinal direction; a first blade coupled to the bit body with a first outward surface; a second blade coupled to the bit body with a second outward surface; a third blade coupled to the bit body with a third outward surface; a first rolling cutting element having a cutting element axis in plane with a first radial plane of the rotational axis positioned on the first outward surface; a first fixed cutting element positioned with a first fixed cutting profile at least partially rotationally overlapping with a first rolling cutting profile of the first rolling cutting element, the first fixed cutting element positioned on the second outward surface; a second rolling cutting element having a cutting element axis in plane with a second radial plane of the rotational axis positioned on the second outward surface; and a second fixed cutting element positioned with a second fixed cutting profile at least partially rotationally overlapping with a second rolling cutting profile of the second rolling cutting element, the second fixed cutting element positioned on the third outward surface, wherein the first rolling cutting profile rotationally overlaps the second rolling cutting profile.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 4-1 is a side view of a set of cutting elements including a rolling cutting element and fixed cutting elements, according to at least some embodiments of the present disclosure.

FIG. 4-2 is a rotational end view of the set of cutting elements of FIG. 4-1.

DETAILED DESCRIPTION

Figure 1:
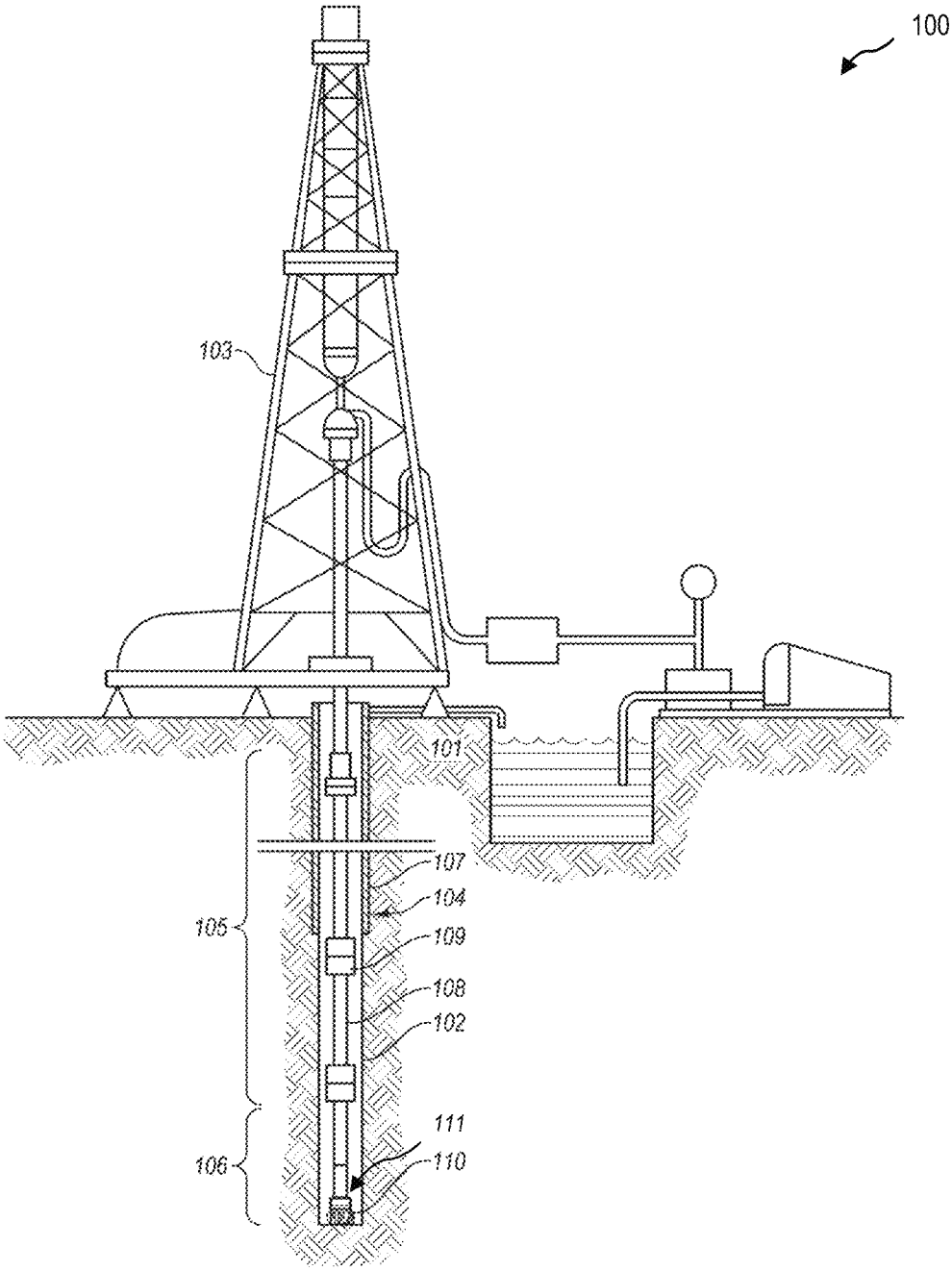
FIG. 1 illustrates an embodiment of a drilling system and downhole environment in which a drill bit, according to the present disclosure, may be used.

Embodiments of the present disclosure generally relate to devices, systems, and methods for drilling in an earth formation. More particularly, some embodiments of the present disclosure relate to drill bits including a two-stage system for degrading and/or removing material from the earth formation. In some embodiments, a drill bit includes a rolling cutting element and a fixed cutting element in sequence to crack, crush, deform, or otherwise degrade the material of the earth formation before removing the degraded material. In some embodiments, the rolling cutting element rolls across a surface of the formation material of the earth formation to apply a compression force and/or a shear force to degrade the formation material into a degraded material, and the fixed cutting element drags across or through the degraded material to remove at least a portion of the degraded material.

In some embodiments, the drill bit has a rotational direction in which the cutting elements of the drill bit are oriented. In some embodiments, the rolling cutting element is positioned rotationally before the fixed cutting element(s) in the rotational direction. For example, the rolling cutting element contacts a portion of the formation material before the fixed cutting element(s) as the drill bit rotates in the downhole environment. In some embodiments, a plurality of fixed cutting elements is positioned rotationally after the rolling cutting element. In some embodiments, the fixed cutting elements of the plurality of fixed cutting elements are staggered or otherwise positioned to rotationally overlap the cutting profile of the fixed cutting elements to provide a substantially continuous fixed cutting profile that rotationally overlaps and/or matches a rolling cutting profile of the associated rolling cutting element. For example, the cutting profiles rotationally overlap when the rolling cutting profile of the rolling cutting element and the fixed cutting profile of the plurality of fixed cutting elements is rotated into a single radial plane, and the rolling cutting profile and the fixed cutting profile overlap.

In some embodiments, the rolling cutting element includes a plurality of ridges, peaks, or other surface features thereon to increase the pressure of the rolling cutting element on the surface of the formation material and/or provide relief volume between the ridges for formation material to deform or move into as the ridges apply pressure to the formation material. The rolling cutting element, therefore allows the drill bit to exert a force to the formation material and degrade the formation material with less torque than fixed cutting elements configured to drag across the surface of the formation material. The associated fixed cutting elements rotationally after the rolling cutting elements, in some embodiments, remove the degraded material with less damage to the fixed cutting elements, at a greater cutting depth, at a greater cutting rate, or combinations thereof when compared to fixed cutting elements acting on formation material that is not degraded by rolling cutting elements. In some embodiments, a drill bit according to the present disclosure can remove material in challenging earth formations with greater drilling rate, less torque, greater weight-on-bit, less wear or damage to the drill bit, or combinations thereof relative to conventional drill bits.

FIG. 1 illustrates an embodiment of a drilling system and downhole environment in which a drill bit, according to the present disclosure may, be used. FIG. 1 shows one example of a drilling system 100 for drilling an earth formation 101 to form a wellbore 102. The drilling system 100 includes a drill rig 103 used to turn a drilling assembly 104 which extends downward into the wellbore 102. The drilling assembly 104 may include a drill string 105 and a bottom-hole assembly (BHA) 106 attached to the downhole end of the drill string 105. Where the drilling system 100 is used for drilling formation, a drill bit 110 can be included at the downhole end of the bottom hole assembly or BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the wellbore 102 as it is being drilled, and for preventing the collapse of the wellbore 102. The drilling fluid 111 carries drill solids including drill fines, drill cuttings, and other swarf from the wellbore 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 includes any features or elements suitable for degrading downhole materials. For instance, the bit 110 may be a drill bit suitable for drilling the earth formation 101. While embodiments of a drill bit 110 for drilling the earth formation 101 will be described herein, it should be understood that, in some embodiments, features described herein are applicable to a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface by the drilling fluid 111 or may be allowed to fall downhole. The conditions of the equipment of the drilling system 100, the formation 101, the wellbore 102, the drilling fluid 111, or other parts of the wellsite can change during operations.

Figure 2:
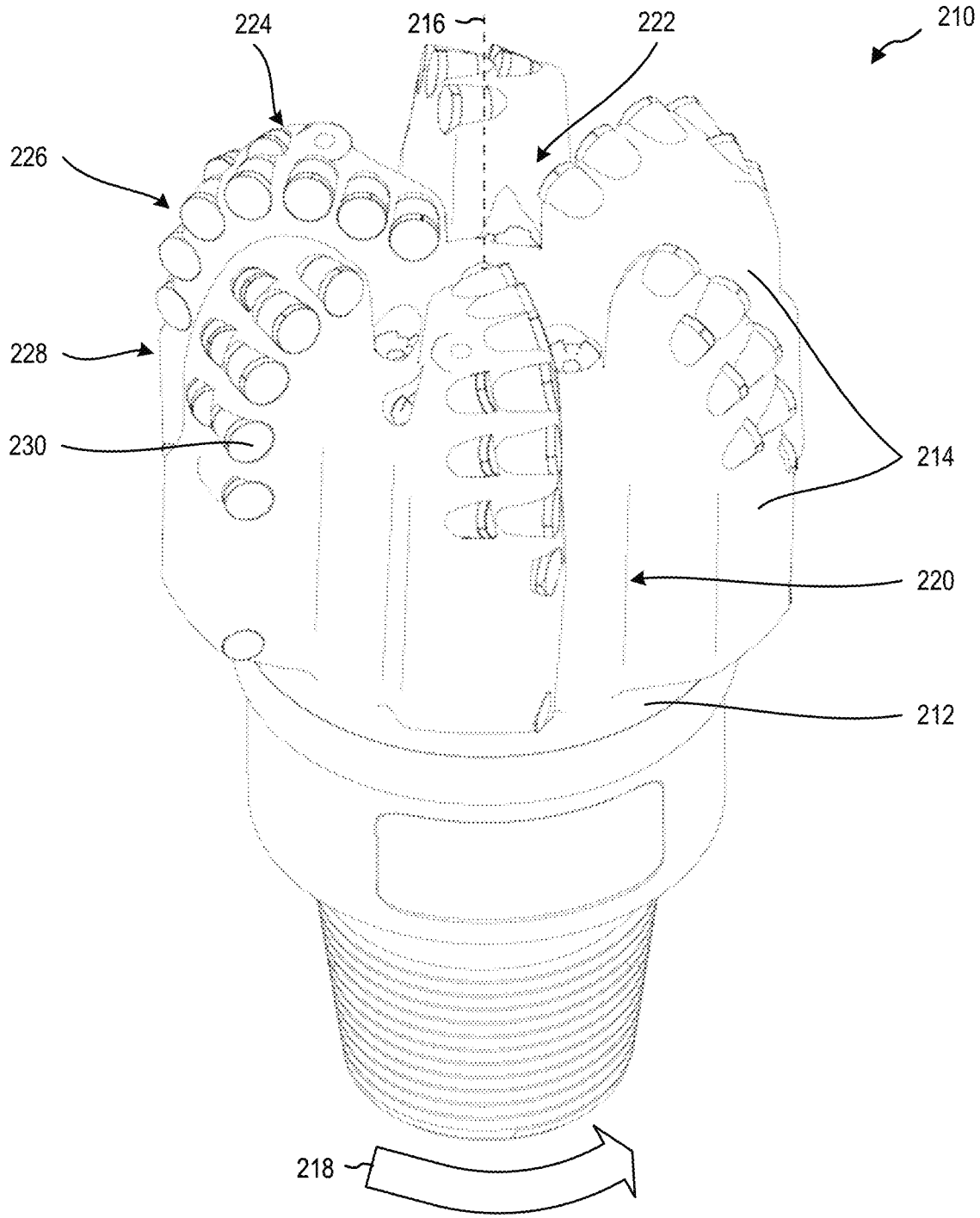
FIG. 2 Prior Art
FIG. 2 is a bottom perspective view illustrating components of a conventional drill bit.

FIG. 2 is a bottom perspective view of an embodiment of a conventional drill bit 210 with an example geometry. In some embodiments, a drill bit 210 includes a bit body 212 with a plurality of blades 214 coupled thereto. The blades 214 protrude from the bit body 212 in a longitudinal direction of a rotational axis 216 and in a radial direction outward from the rotational axis 216. In some embodiments, the blades 214 are separated from one another in a rotational direction 218 around the rotational axis 216 by slots 220.

In some embodiments, the drill bit 210 includes a cone region 222 proximate the rotational axis 216 at a terminal longitudinal end of the drill bit 210. Radially outside of the cone region 222 is a nose region 224. Radially outside of the nose region 224 is the shoulder region 226. Radially outside of the shoulder region 226 and longitudinally rearward from the shoulder region 226 and nose region 224 is the gauge surface 228 of the drill bit 210. In some embodiments, at least one of the cone region 222, the nose region 224, the shoulder region 226, and the gauge surface 228 contacts and applies a compression force to the formation material during drilling. In some embodiments, at least one of the cone region 222, the nose region 224, the shoulder region 226, and the gauge surface 228 contacts and applies a shear force to the formation material during drilling.

In the embodiment of a drill bit 210 illustrated in FIG. 2, the cutting elements 230 are fixed cutting elements that each drag across or in the formation material to remove the formation material. In some formation materials, the torque-on-bit (e.g., the torque applied to the bit 210 around the rotational axis 216) and/or the weight-on-bit (e.g., the longitudinal force applied to the bit 210 in the longitudinal direction of the rotational axis 216) can be reduced (or the rate of penetration (ROP) can be increased) by replacing at least some of the fixed cutting elements with rolling cutting elements according to the present disclosure. In other applications, penetration rate of the bit may be maintained or improved with significantly less rotational speed of the bit, thereby reducing the need for high-performance downhole motors as part of the BHA.

Figure 3:
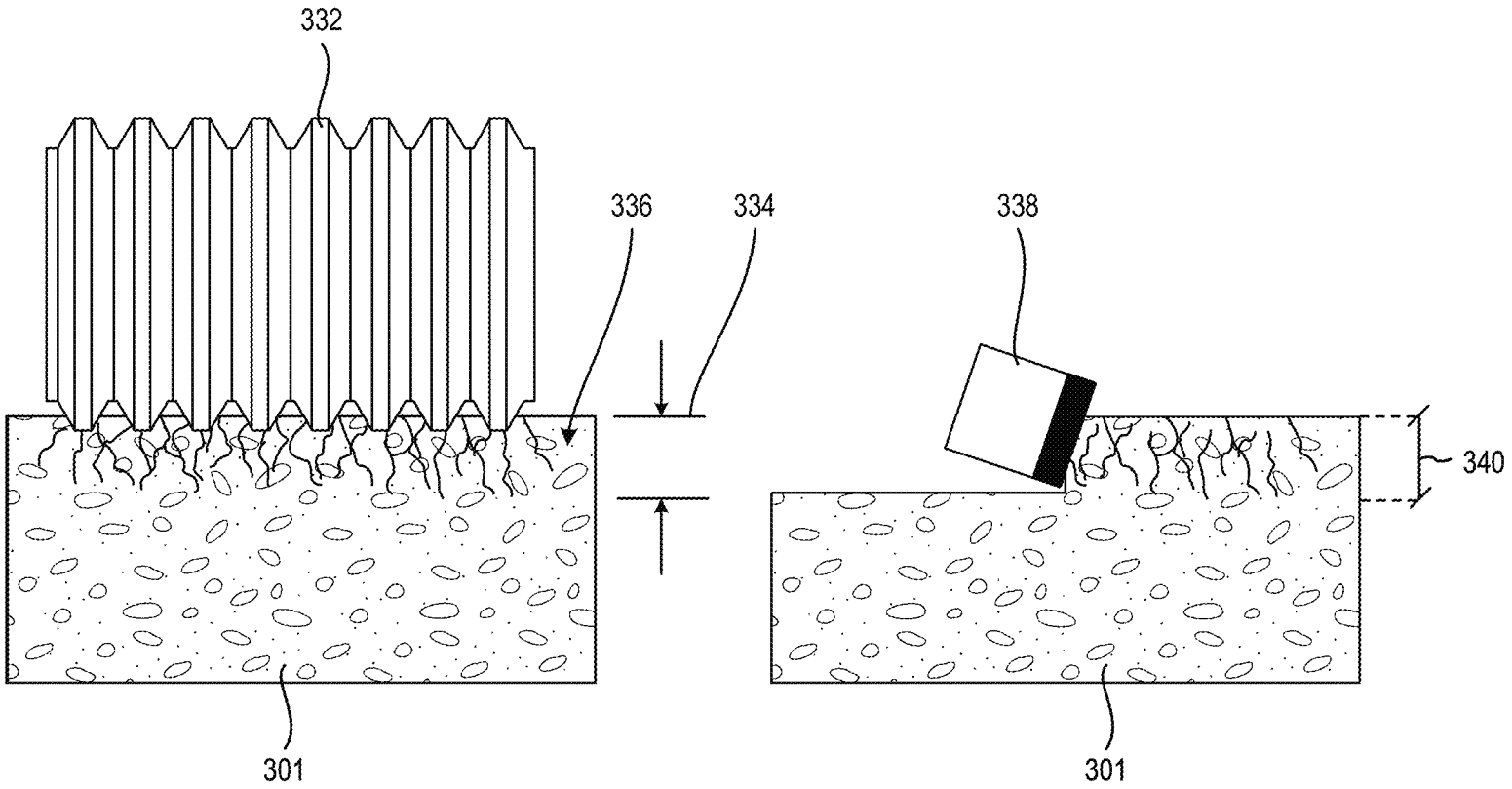
FIG. 3 is an example illustration of a rolling cutting element degrading the formation and inducing a damaged zone of degraded material, according to at least some embodiments of the present disclosure.

FIG. 3 is an example illustration of a rolling cutting element 332 degrading the formation 301 and inducing a damaged zone 334 of degraded material 336. In some embodiments, the rolling cutting element 332 includes and/or is made of an ultrahard material. In some embodiments, the working surface of the rolling cutting element is an ultrahard material. In at least one embodiment, the rolling cutting element, or a working surface thereof, is made of or includes a polycrystalline diamond compact (PDC).

In some embodiments, a fixed cutting element 338, including but not limited to a shear cutting element, an apexed cutting element (conical, bullet, ridged), or another fixed cutting element with another surface geometry, applies a force to the degraded material 336 to remove at least a portion of the degraded material 336. In some embodiments, the fixed cutting element 338 is a spinning cutting element that allows the fixed cutting element (such as a shear cutting element) to spin in a housing and expose different cutting surfaces to the formation. In some embodiments, the fixed cutting element(s) 438 is made of or includes a PDC.

In some embodiments, the fixed cutting element has a depth of cut 340 that is substantially equal to the depth of the damaged zone 334. In some embodiments, the fixed cutting element has a depth of cut 340 that is less than the depth of the damaged zone 334. In some embodiments, the fixed cutting element has a depth of cut 340 that is greater than the depth of the damaged zone 334.

Figures 1, 4:
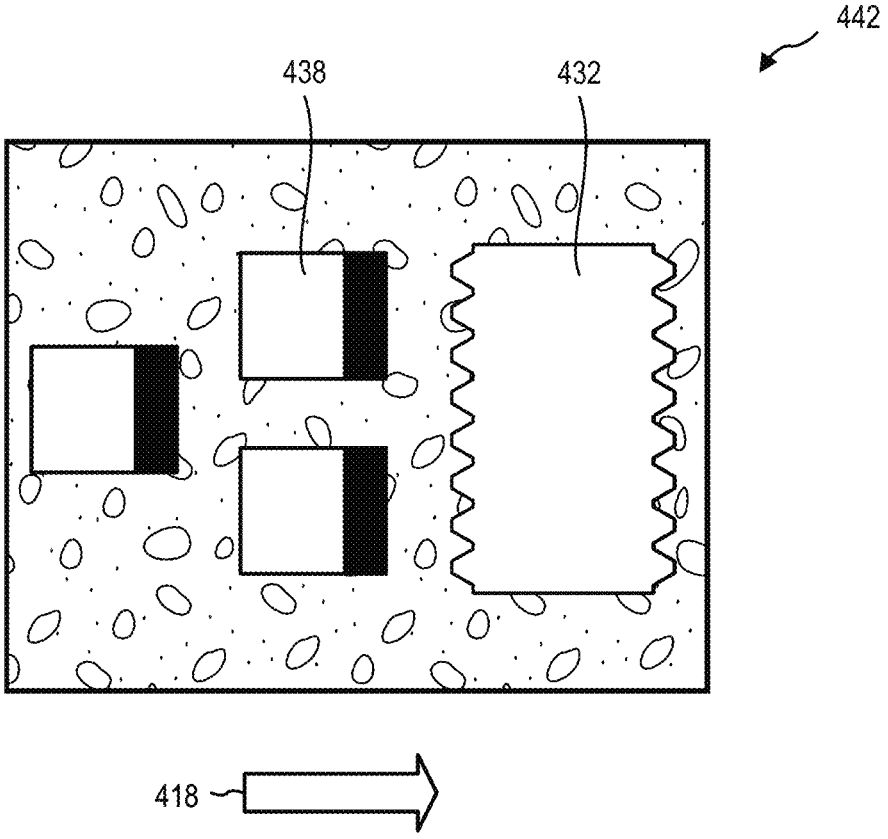
Figures 2, 4:
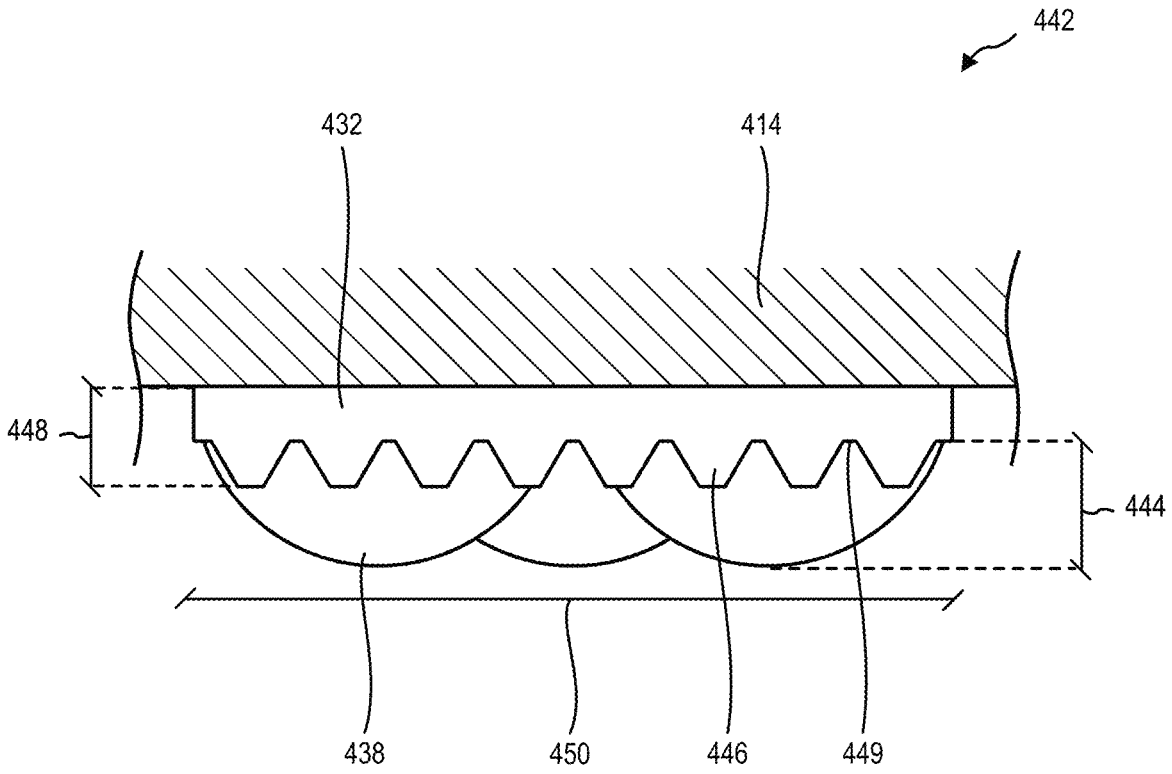

FIG. 4-1 is a side view of an embodiment of a set 442 of cutting elements 432, 438 according to the present disclosure. In some embodiments, a set 442 of cutting elements includes at least one rolling cutting element 432 and at least one fixed cutting element 438. In some embodiments, a set of cutting elements includes a rolling cutting element 432 and a plurality of fixed cutting elements 438. In some embodiments, the fixed cutting element(s) 438 is positioned after the rolling cutting element 432 relative to the rotational direction 418 such that the fixed cutting profile of the fixed cutting element(s) 438 rotationally overlaps the rolling cutting profile of the rolling cutting element 432.

FIG. 4-2 is a rotational end view of the set 442 of cutting elements of FIG. 4-1. In some embodiments, the fixed cutting elements 438 have a DOC greater than a ridge height 448 of the ridges 446 of the rolling cutting element 432 above the surface of the blade 414. In some embodiments, the fixed cutting elements 438 have a prominence 444 beyond the troughs 449 (between the ridges 446 or other surface of the rolling cutting element 432) that is at least 1 millimeter. In some embodiments, the fixed cutting elements 438 have a prominence 444 greater than 2 millimeters. In some embodiments, the fixed cutting elements 438 have a prominence 444 greater than 5 millimeters. In some embodiments, the fixed cutting elements 438 have a prominence 444 that is greater than the ridge height 448. In some embodiments, the fixed cutting elements 438 have a prominence 444 that is greater than the ridge height 448 by at least 50% of the ridge height 448. In some embodiments, the fixed cutting elements 438 have a prominence 444 that is greater than the ridge height 448 by at least 100% of the ridge height 448. In some embodiments, the fixed cutting elements 438 have a prominence 444 that is greater than the ridge height 448 by at least 150% of the ridge height 448.

In some embodiments, the ridge height 448 is substantially consistent along a length 450 of the rolling cutting element 432 wherein the length 450 is parallel to the cutting element axis. A substantially consistent ridge height 448 approximates a straight line across the ridges 446 of the rolling cutting element. In some embodiments, the ridge height 448 varies along the length 450 of the rolling cutting element 432, allowing the rolling cutting element 432 to contact and degrade a curved section of the formation material. In particular, a rolling cutting element 432 positioned on a nose region or shoulder region of a drill bit may use a varying ridge height to substantially match a curvature of the blade of the drill bit at that location.

In some embodiments, the plurality of fixed cutting elements 438 is positioned after the rolling cutting element 432 within a length 450 of the rolling cutting element 432 and/or the rolling cutting profile such that the fixed cutting profile of the fixed cutting element(s) 438 rotationally overlaps the rolling cutting profile of the rolling cutting element 432. In some embodiments, the plurality of fixed cutting elements 438 is positioned after the rolling cutting element 432 such that a fixed cutting profile of the fixed cutting elements 438 occupies at least 50% of the length 450 of the rolling cutting element 432 and/or the rolling cutting profile. In some embodiments, the plurality of fixed cutting elements 438 is positioned after the rolling cutting element 432 such that a fixed cutting profile of the fixed cutting elements 438 occupies at least 75% of the length 450 of the rolling cutting element 432 and/or the rolling cutting profile. In some embodiments, the plurality of fixed cutting elements 438 is positioned after the rolling cutting element 432 such that a fixed cutting profile of the fixed cutting elements 438 occupies at least 90% of the length 450 of the rolling cutting element 432 and/or the rolling cutting profile. In at least one embodiment, the length 450 of the rolling cutting element 432 and/or the rolling cutting profile is no less than a length of the fixed cutting profile. Rotationally overlapping the fixed cutting element(s) 438 within the length 450 of the rolling cutting element 432 allows the fixed cutting element(s) 438 to remove degraded material and/or unsupported material.

Figure 5:
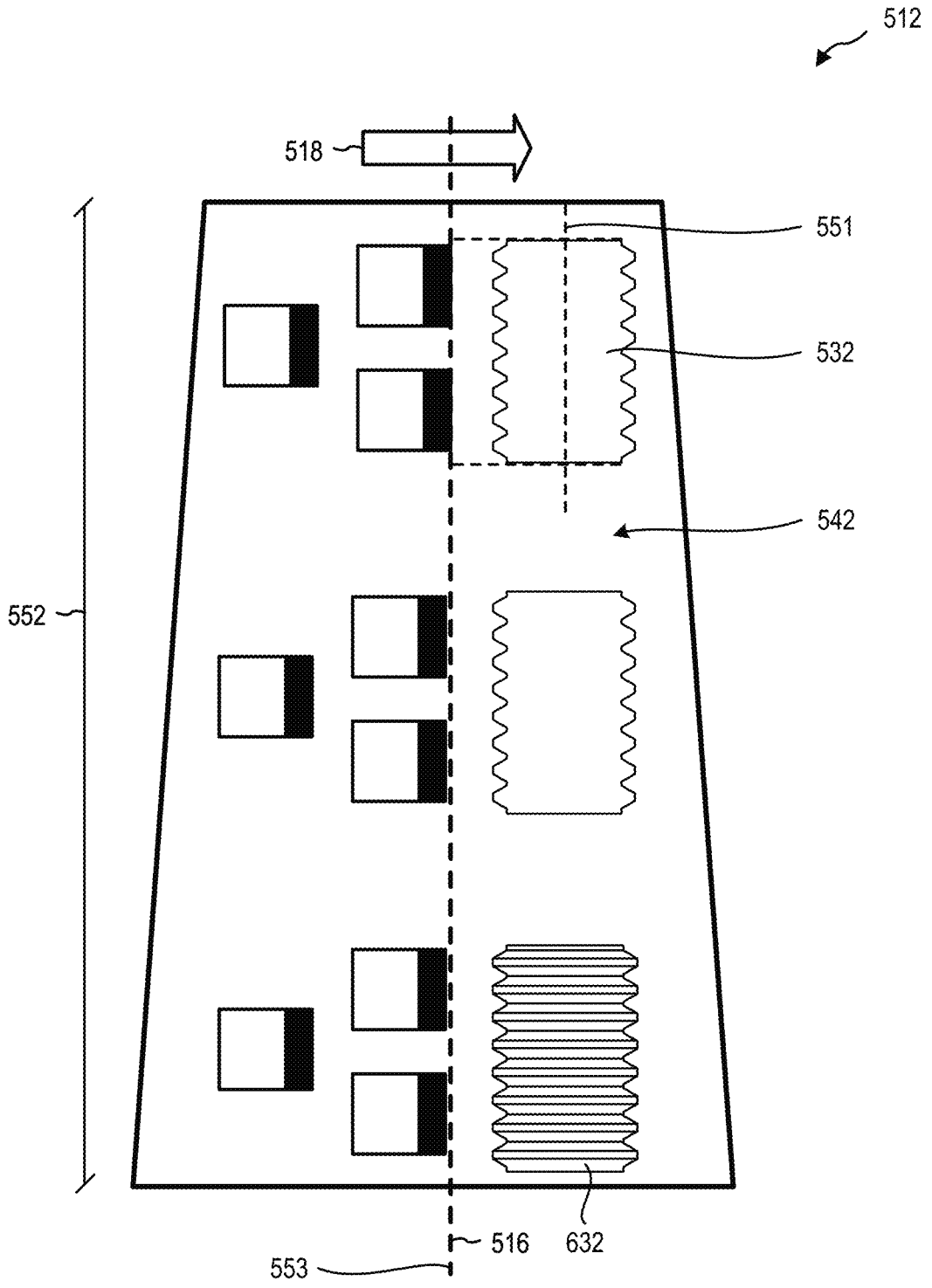
FIG. 5 is a perspective view of an outward surface of a blade with plurality of sets of cutting elements positioned thereon, according to at least some embodiments of the present disclosure.

FIG. 5 is a perspective view of an embodiment of an outward surface of a blade 512 with plurality of sets 542 of cutting elements positioned thereon. In some embodiments, a blade 512 includes a plurality of rolling cutting elements 532 that occupy at least 20% of a blade length 552 of the blade 512. In some embodiments, a blade 512 includes a plurality of rolling cutting elements 532 that occupy at least 40% of a blade length 552 of the blade 512. In some embodiments, a blade 512 includes a plurality of rolling cutting elements 532 that occupy at least 60% of a blade length 552 of the blade 512. In some embodiments, the sets 542 of cutting elements do not occupy a full blade length 552 of the blade 512, as subsequent blades 512 of the drill bit include additional sets 542 of cutting elements.

The rolling cutting elements 532 roll relative to the surface of the blade 512 around a cutting element axis 551. The cutting element axis 551 is, in some embodiments, parallel to the rotational axis 516 of the drill bit. In some embodiments, the cutting element axis 551 lies in a radial plane 553 of the rotational axis 516. For example, a rolling cutting element 532 positioned on a nose region or shoulder region of the blade 512 and/or drill bit has a cutting element axis 551 that is non-parallel with the rotational axis 516 (as the surface of the blade 512 at the nose region or shoulder region is not parallel to the longitudinal direction) but the cutting element axis 551 is positioned in a radial plane 553 of the rotational axis 516. With a cutting element axis 551 in a radial plane 553, the rolling cutting element 532 rotates freely when the drill bit rotates around the rotational axis 516.

In some embodiments, the cutting element axis 551 is oriented at an angle to a radial plane 553 of the rotational axis 516. For example, the rolling cutting element 532 and cutting element axis 551 may be oriented with a rake or backrake relative to the rotational axis 516 and the rotational direction 518 such that the rolling cutting element 532 applies both a compression force to the formation material and a shear force to the formation material. Changes to the orientation of the cutting element axis 551 alter the proportional amount of rotation and drag of the rolling cutting element relative to the surface of the formation material. Alternatively, the rolling element can be tapered such that it geometrically rolls in an arc corresponding with its radial position, in this case there is a minimal amount of shear force applied to the formation by the rolling element.

Figure 6:
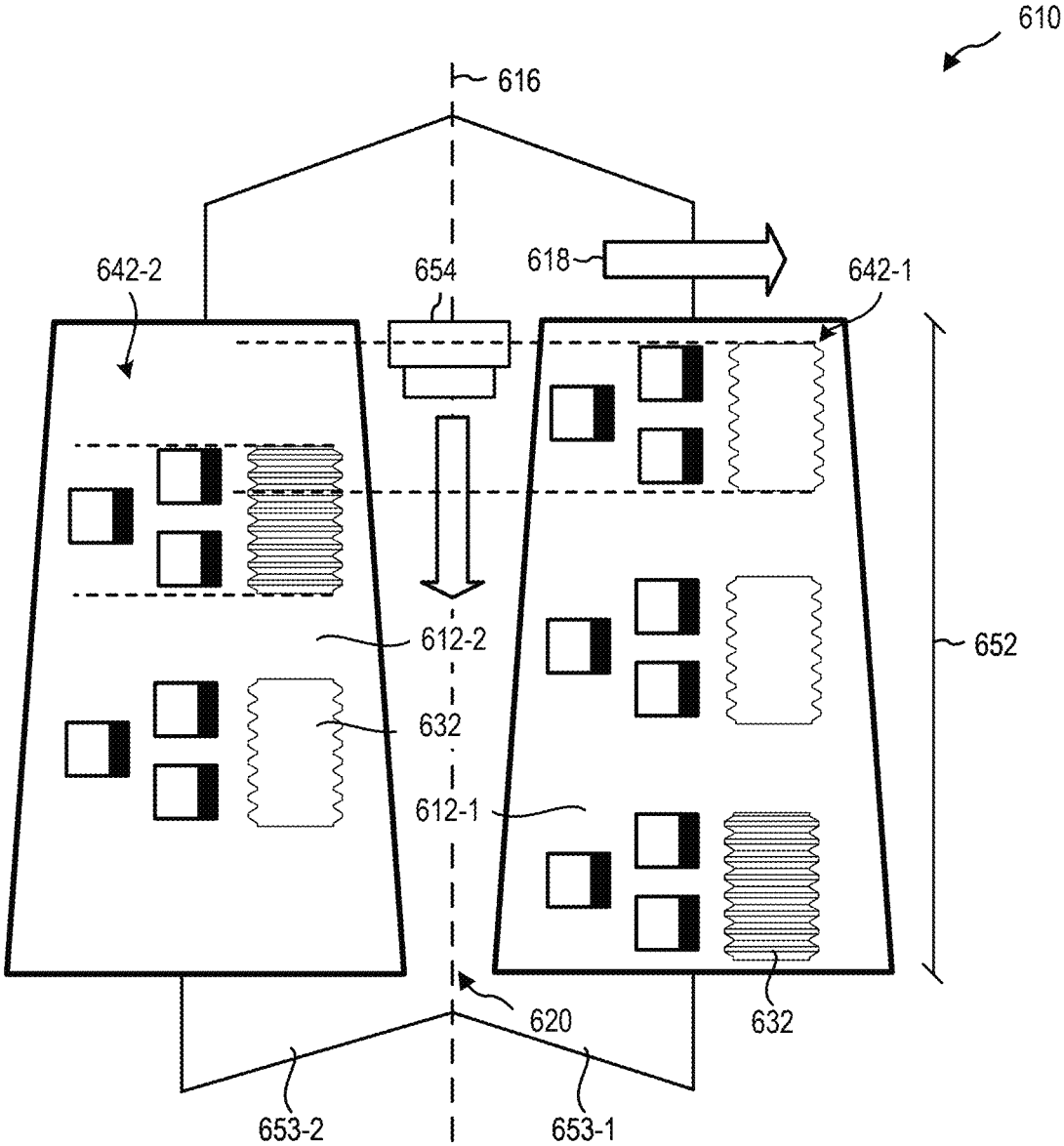
FIG. 6 is a perspective view of outward surfaces of two blades of a drill bit with plurality of sets of cutting elements positioned on each of the blades, according to at least some embodiments of the present disclosure.

For example, FIG. 6 is a perspective view of an embodiment of outward surfaces of two blades 612-1, 612-2 of a drill bit 610 with plurality of sets 642-1, 642-2 of cutting elements positioned on each of the blades 612-1, 612-2. In some embodiments, the first blade 612-1 is rotationally before the second blade 612-2 in the rotational direction 618, and the first blade 612-1 has a first set 642-1 of cutting elements and the second blade 612-2 has a second set 642-2 of cutting elements. In some embodiments, the first set 642-1 of cutting elements includes a rolling cutting element 632 in a first radial plane 653-1 of the rotational axis 616 of the drill bit, and the second set 642-2 of cutting elements includes a rolling cutting element 632 in a second radial plane 653-2 of the rotational axis 616 of the drill bit. The rolling cutting profile of the first set 642-1 of cutting elements at least partially rotationally overlaps the rolling cutting profile of the second set 642-2 of cutting elements in a longitudinal direction. In some embodiments, each of the sets of cutting elements on the first blade 612-1 at least partially rotationally overlaps at least one other set of cutting elements on the second blade 612-2. In some embodiments, each of the sets of cutting elements at least partially rotationally overlaps at least one other set of cutting elements on the drill bit 610.

In some embodiments, the first blade 612-1 and the second blade 612-2 have a slot 620 therebetween that allows fluid flow between the blades to clear cuttings, swarf, or other debris. In some embodiments, a hydraulic nozzle 654 directs a fluid flow, such as a drilling fluid flow, into the slot 620 to clear the cuttings, swarf, or other debris. In some embodiments, degraded material remains in the degraded formation after the fixed cutting elements of the first set 642-1 of cutting element remove material from the formation. The fluid flow can further dislodge or flush remaining degraded material from the formation to further assist the second set 642-2 of cutting elements further degrading and/or removing material.

In some embodiments, a combination of the first blade 612-1 and the second blade 612-2 includes a plurality of rolling cutting elements 632 that occupy at least 50% of a blade length 652 of the blades 612-1, 612-2. In some embodiments, the combination of the first blade 612-1 and the second blade 612-2 includes a plurality of rolling cutting elements 632 that occupy at least 75% of a blade length 652 of the blades 612-1, 612-2. In some embodiments, the combination of the first blade 612-1 and the second blade 612-2 includes a plurality of rolling cutting elements 632 that occupy at least 90% of a blade length 652 of the blades 612-1, 612-2.

Figure 7:
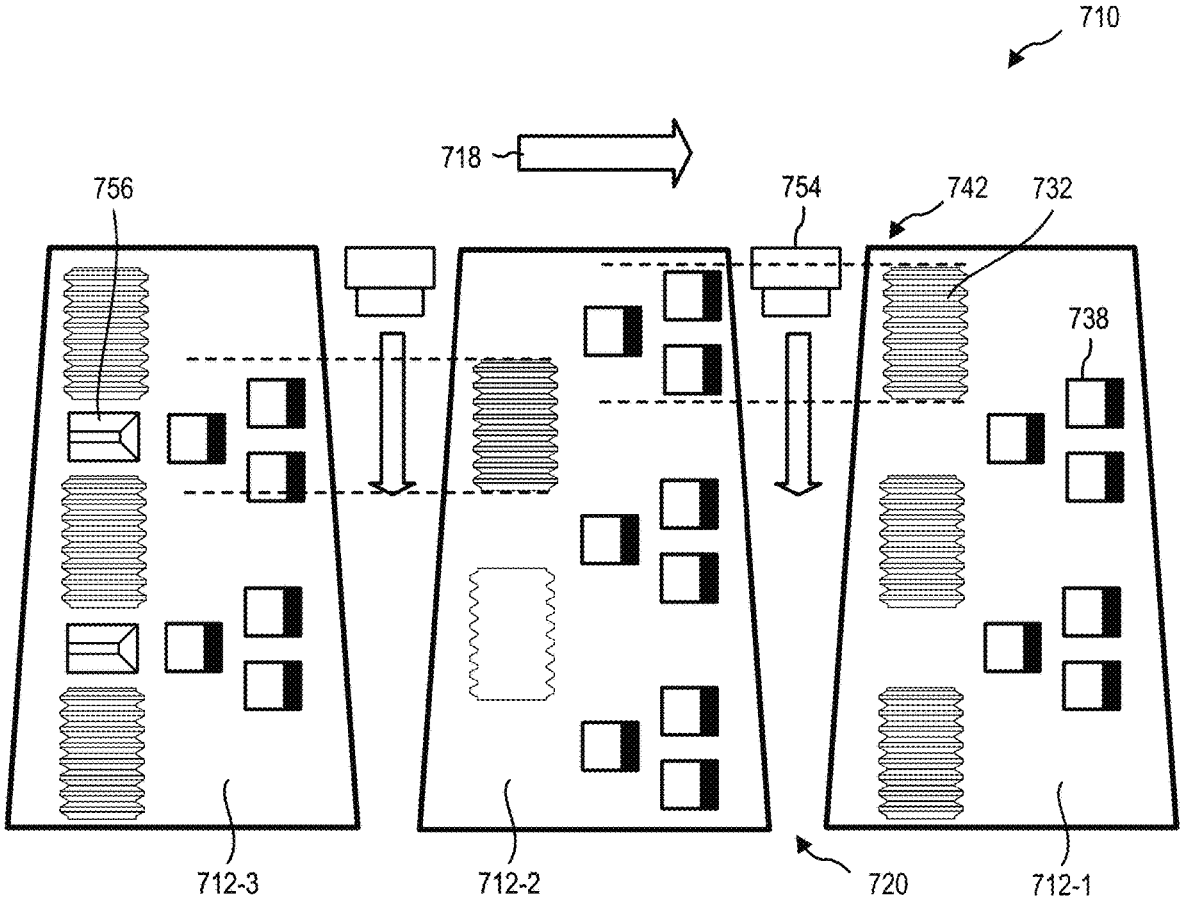
FIG. 7 is a perspective view of outward surface of two or more blades with fixed cutting elements positioned rotationally after the rolling cutting element relative to a rotational direction of the drill bit, according to at least some embodiments of the present disclosure.

Referring now to FIG. 7, in some embodiments, at least one of the sets 742 of cutting elements is distributed between two or more blades 712-1, 712-2 712-3, with the fixed cutting elements 738 positioned rotationally after the rolling cutting element 732 relative to a rotational direction 718 of the drill bit 710 such that the fixed cutting profile of the fixed cutting element(s) 738 rotationally overlaps the rolling cutting profile of the rolling cutting element 732. The rolling cutting element 732 on the first blade 712-1, for example, degrades the formation material, and the fixed cutting element 738 on the second blade 712-2 removes the degraded material. A rolling cutting element 732 on the second blade 712-2 degrades the formation material, and the fixed cutting element 738 on the third blade 712-3 removes the degraded material. In some embodiments, a fluid flow through the slot 720 between the first blade 712-1 and the second blade 712-2 further dislodges or degrades the degraded material, allowing the fixed cutting element(s) 738 to remove the degraded material more easily. In some embodiments, a hydraulic nozzle 754 in or proximate to the slot 720 directs fluid flow at the degraded material between the rolling cutting element 732 and the fixed cutting element(s) 738 of the set 742 of cutting elements. In some embodiments, the hydraulic nozzle 754 is positioned in the slot 720 rotationally between the rolling cutting elements 732 of different sets 742 of cutting elements. In some embodiments, the hydraulic nozzle 754 is positioned in the slot 720 rotationally between the rolling cutting element 732 (on a first blade 712-1) and the fixed cutting element 738 (on a second blade 712-2) of a set 742.

In some embodiments, the set 742 of cutting elements has no intervening features therebetween. In some embodiments, the rolling cutting element 732 and the fixed cutting elements 738 are immediately rotationally adjacent to one another such that the fixed cutting profile of the fixed cutting element(s) 738 rotationally overlaps the rolling cutting profile of the rolling cutting element 732. In some embodiments, the rolling cutting element 732 and the fixed cutting elements 738 are rotationally adjacent to one another with a slot 720 therebetween such that the fixed cutting profile of the fixed cutting element(s) 738 rotationally overlaps the rolling cutting profile of the rolling cutting element 732. In some embodiments, the drill bit 710 includes an additional feature or components rotationally between the rolling cutting element 732 and the fixed cutting element(s) 738 of the set 742. In at least one embodiment, the drill bit 710 includes at least one depth limiter 756 that limits a DOC of the fixed cutting elements 738 and/or a depth of degradation or damage from the rolling cutting elements 732. Additional features may further include nozzles, jets, gauge pads and other wear-resistance components, or other elements of the drill bit 710 positioned on the outward-facing surface of the blades.

Figure 8:
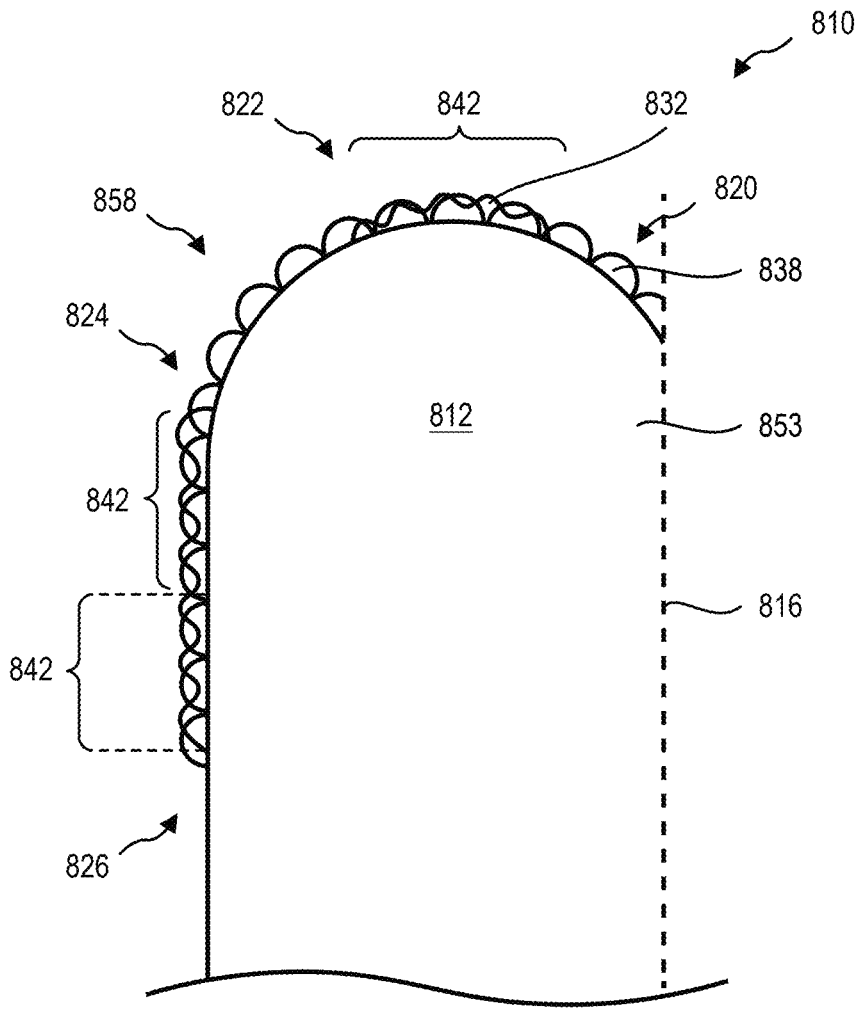
FIG. 8 illustrates a cutting profile of an embodiment of a drill bit with the cutting elements (both rolling and fixed cutting elements) rotated around the rotational axis into a single radial plane, according to at least some embodiments of the present disclosure.

FIG. 8 illustrates a cutting profile of an embodiment of a drill bit 810 with the cutting elements (both rolling and fixed cutting elements) rotated around the rotational axis 816 into a single radial plane 853. For example, as the drill bit 810 rotates a full revolution, the cutting elements of the drill bit 810 form a cutting profile 858 that results from the relative position of the cutting elements on all blades of the drill bit. In some embodiments, a set 842 of cutting elements according to any embodiment described herein is positioned on a nose region 822 of the drill bit 810. In some embodiments, the set 842 is positioned on a single blade. In some embodiments, the set 842 is distributed between a plurality of blades with the fixed cutting elements rotationally after the rolling cutting element. In some embodiments, a set 842 is positioned on a shoulder region 824 of the drill bit 810. In some embodiments, a set 842 is positioned on a gauge surface 826 of the drill bit 810. In some embodiments, a set 842 is positioned on a cone region 820 of the drill bit 810. In some embodiments, the cone region 820 includes fixed cutting elements 838 and lacks a rolling cutting element.

As described herein, in some embodiments, the ridge height varies along the length of the rolling cutting element, allowing the rolling cutting element 832 to contact and degrade a curved section of the formation material. In particular, a rolling cutting element 832 positioned on a nose region 822 or shoulder region 824 of a drill bit 810 may use a varying ridge height to substantially match a curvature of the blade 812 of the drill bit 810 at that location on the cutting profile 858.

In some embodiments, a plurality of sets 842 of cutting elements overlap with one another to provide a substantially continuous degradation and removal of formation material. In some embodiments, the rolling cutting profile of each rolling cutting element overlaps substantially continuously along at least a portion of the cutting profile of the drill bit. In some embodiments, the rolling cutting profile of each rolling cutting element overlaps substantially continuously along at least a nose region 822 and a shoulder region 824 of the cutting profile of the drill bit.

In at least some embodiments according to the present disclosure, a drill bit with sets of cutting elements including a rolling cutting element rotationally before a plurality of fixed cutting elements allows for higher ROP and/or lower WOB and TOB while drilling some formations.

INDUSTRIAL APPLICABILITY

Embodiments of the present disclosure generally relate to devices, systems, and methods for drilling in an earth formation. More particularly, some embodiments of the present disclosure relate to drill bits including a two-stage system for degrading and/or removing material from the earth formation. In some embodiments, a drill bit includes a rolling cutting element and a fixed cutting element in sequence to crack, crush, deform, or otherwise degrade the material of the earth formation before removing the degraded material. In some embodiments, the rolling cutting element rolls across a surface of the formation material of the earth formation to apply a compression force and/or a shear force to degrade the formation material into a degraded material, and the fixed cutting element drags across or through the degraded material to remove at least a portion of the degraded material.

In some embodiments, the drill bit has a rotational direction in which the cutting elements of the drill bit are oriented. In some embodiments, the rolling cutting element is positioned rotationally before the fixed cutting element(s) in the rotational direction. For example, the rolling cutting element contacts a portion of the formation material before the fixed cutting element(s) as the drill bit rotates in the downhole environment. In some embodiments, a plurality of fixed cutting elements is positioned rotationally after the rolling cutting element. In some embodiments, the fixed cutting elements of the plurality of fixed cutting elements are staggered or otherwise positioned to rotationally overlap the cutting profile of the fixed cutting elements to provide a substantially continuous fixed cutting profile that rotationally overlaps and/or matches a rolling cutting profile of the associated rolling cutting element. For example, the cutting profiles rotationally overlap when the rolling cutting profile of the rolling cutting element and the fixed cutting profile of the plurality of fixed cutting elements is rotated into a single radial plane, and the rolling cutting profile and the fixed cutting profile overlap.

In some embodiments, the rolling cutting element includes a plurality of ridges, peaks, or other surface features thereon to increase the pressure of the rolling cutting element on the surface of the formation material and/or provide relief volume between the ridges for formation material to deform or move into as the ridges apply pressure to the formation material. The rolling cutting element, therefore allows the drill bit to exert a force to the formation material and degrade the formation material with less torque than fixed cutting elements configured to drag across the surface of the formation material. In some other applications it may decrease the need for high speed downhole mud motors. The associated fixed cutting elements rotationally after the rolling cutting elements, in some embodiments, remove the degraded material with less damage to the fixed cutting elements, at a greater cutting depth, at a greater cutting rate, or combinations thereof when compared to fixed cutting elements acting on formation material that is not degraded by rolling cutting elements. In some embodiments, a drill bit according to the present disclosure can remove material in challenging earth formations with greater drilling rate, less torque, greater weight-on-bit, less wear or damage to the drill bit, or combinations thereof relative to conventional drill bits.

In some embodiments, a drill bit on which the cutting elements and sets of cutting elements described here are used includes a bit body with a plurality of blades coupled thereto. The blades protrude from the bit body in a longitudinal direction of a rotational axis and in a radial direction outward from the rotational axis. In some embodiments, the blades are separated from one another in a rotational direction around the rotational axis by slots.

In some embodiments, the drill bit includes a cone region proximate the rotational axis at a terminal longitudinal end of the drill bit. Radially outside of the cone region is a nose region. Radially outside of the nose region is the shoulder region. Radially outside of the shoulder region and longitudinally rearward from the shoulder region and nose region is the gauge surface of the drill bit. In some embodiments, at least one of the cone region, the nose region, the shoulder region, and the gauge surface contacts and applies a compression force to the formation material during drilling. In some embodiments, at least one of the cone region, the nose region, the shoulder region, and the gauge surface contacts and applies a shear force to the formation material during drilling.

In some embodiments, the cutting elements are fixed cutting elements that each drag across or in the formation material to remove the formation material. In some formation materials, the torque-on-bit (e.g., the torque applied to the bit around the rotational axis) and/or the weight-on-bit (e.g., the longitudinal force applied to the bit in the longitudinal direction of the rotational axis) can be reduced (or the rate of penetration (ROP) can be increased) by replacing at least some of the fixed cutting elements with rolling cutting elements according to the present disclosure. Reducing torque has the added benefit of improving bit steerability in many applications, which is important in directional drilling.

In some embodiments, the rolling cutting element includes and/or is made of an ultrahard material. In some embodiments, the working surface of the rolling cutting element is an ultrahard material. In at least one embodiment, the rolling cutting element, or a working surface thereof, is made of or includes a polycrystalline diamond compact (PDC).

In some embodiments, a fixed cutting element, including but not limited to a shear cutting element, an apexed cutting element (conical, bullet, ridged), or another fixed cutting element with another surface geometry, applies a force to the degraded material to remove at least a portion of the degraded material. In some embodiments, the fixed cutting element is a spinning cutting element that allows the fixed cutting element (such as a shear cutting element) to spin in a housing and expose different cutting surfaces to the formation. In some embodiments, the fixed cutting element (s) is made of or includes a PDC.

In some embodiments, the fixed cutting element has a depth of cut that is substantially equal to the depth of the damaged zone. In some embodiments, the fixed cutting element has a depth of cut that is less than the depth of the damaged zone. In some embodiments, the fixed cutting element has a depth of cut that is greater than the depth of the damaged zone.

In some embodiments, a set of cutting elements includes at least one rolling cutting element and at least one fixed cutting element. In some embodiments, a set of cutting elements includes a rolling cutting element and a plurality of fixed cutting elements. In some embodiments, the fixed cutting element(s) is positioned after the rolling cutting element relative to the rotational direction such that the fixed cutting profile of the fixed cutting element(s) rotationally overlaps the rolling cutting profile of the rolling cutting element.

In some embodiments, the fixed cutting elements have a DOC greater than a ridge height of the ridges of the rolling cutting element above the surface of the blade. In some embodiments, the fixed cutting elements have a prominence beyond the troughs (between the ridges or other surface of the rolling cutting element) that is at least 1 millimeter. In some embodiments, the fixed cutting elements have a prominence greater than 2 millimeters. In some embodiments, the fixed cutting elements have a prominence greater than 5 millimeters. In some embodiments, the fixed cutting elements have a prominence that is greater than the ridge height. In some embodiments, the fixed cutting elements have a prominence that is greater than the ridge height by at least 50% of the ridge height. In some embodiments, the fixed cutting elements have a prominence that is greater than the ridge height by at least 100% of the ridge height. In some embodiments, the fixed cutting elements have a prominence that is greater than the ridge height by at least 150% of the ridge height.

In some embodiments, the ridge height is substantially consistent along a length of the rolling cutting element. A substantially consistent ridge height approximates a straight line across the ridges of the rolling cutting element. In some embodiments, the ridge height varies along the length of the rolling cutting element, allowing the rolling cutting element to contact and degrade a curved section of the formation material. In particular, a rolling cutting element positioned on a nose region or shoulder region of a drill bit may use a varying ridge height to substantially match a curvature of the blade of the drill bit at that location.

In some embodiments, the plurality of fixed cutting elements is positioned after the rolling cutting element within a length of the rolling cutting element and/or the rolling cutting profile such that the fixed cutting profile of the fixed cutting element(s) rotationally overlaps the rolling cutting profile of the rolling cutting element. In some embodiments, the plurality of fixed cutting elements is positioned after the rolling cutting element such that a fixed cutting profile of the fixed cutting elements occupies at least 50% of the length of the rolling cutting element and/or the rolling cutting profile. In some embodiments, the plurality of fixed cutting elements is positioned after the rolling cutting element such that a fixed cutting profile of the fixed cutting elements occupies at least 75% of the length of the rolling cutting element and/or the rolling cutting profile. In some embodiments, the plurality of fixed cutting elements is positioned after the rolling cutting element such that a fixed cutting profile of the fixed cutting elements occupies at least 90% of the length of the rolling cutting element and/or the rolling cutting profile. In at least one embodiment, the length of the rolling cutting element and/or the rolling cutting profile is no less than a length of the fixed cutting profile. Rotationally overlapping the fixed cutting element(s) within the length of the rolling cutting element allows the fixed cutting element(s) to remove degraded material and/or unsupported material.

In some embodiments, a blade includes a plurality of rolling cutting elements that occupy at least 20% of a blade length of the blade. In some embodiments, a blade includes a plurality of rolling cutting elements that occupy at least 40% of a blade length of the blade. In some embodiments, a blade includes a plurality of rolling cutting elements that occupy at least 60% of a blade length of the blade. In some embodiments, the sets of cutting elements do not occupy a full blade length of the blade, as subsequent blades of the drill bit include additional sets of cutting elements.

The rolling cutting element rolls relative to the surface of the blade around a cutting element axis. The cutting element axis is, in some embodiments, parallel to the rotational axis of the drill bit. In some embodiments, the cutting element axis lies in a radial plane of the rotational axis. For example, a rolling cutting element positioned on a nose region or shoulder region of the blade and/or drill bit has a cutting element axis that is non-parallel with the rotational axis (as the surface of the blade at the nose region or shoulder region is not parallel to the longitudinal direction) but the cutting element axis is positioned in a radial plane of the rotational axis. With a cutting element axis in a radial plane, the rolling cutting element rotates freely when the drill bit rotates around the rotational axis.

In some embodiments, the cutting element axis is oriented at an angle to a radial plane of the rotational axis. For example, the rolling cutting element and cutting element axis may be oriented with a rake or backrake relative to the rotational axis and the rotational direction such that the rolling cutting element applies both a compression force to the formation material and a shear force to the formation material. Changes to the orientation of the cutting element axis alter the proportional amount of rotation and drag of the rolling cutting element relative to the surface of the formation material.

In some embodiments, the first blade is rotationally before the second blade in the rotational direction, and the first blade has a first set of cutting elements and the second blade has a second set of cutting elements. The rolling cutting profile of the first set of cutting elements at least partially rotationally overlaps the rolling cutting profile of the second set of cutting elements in a longitudinal direction. In some embodiments, each of the sets of cutting elements on the first blade at least partially rotationally overlaps at least one other set of cutting elements on the second blade. In some embodiments, each of the sets of cutting elements at least partially rotationally overlaps at least one other set of cutting elements on the drill bit.

In some embodiments, the first blade and the second blade have a slot therebetween that allows fluid flow between the blades to clear cuttings, swarf, or other debris. In some embodiments, a hydraulic nozzle directs a fluid flow, such as a drilling fluid flow, into the slot to clear the cuttings, swarf, or other debris. In some embodiments, degraded material remains in the degraded formation after the fixed cutting elements of the first set of cutting element remove material from the formation. The fluid flow can further dislodge or flush remaining degraded material from the formation to further assist the second set of cutting elements further degrading and/or removing material.

In some embodiments, a combination of the first blade and the second blade includes a plurality of rolling cutting elements that occupy at least 50% of a blade length of the blades. In some embodiments, the combination of the first blade and the second blade includes a plurality of rolling cutting elements that occupy at least 75% of a blade length of the blades. In some embodiments, the combination of the first blade and the second blade includes a plurality of rolling cutting elements that occupy at least 90% of a blade length of the blades.

In some embodiments, at least one of the sets of cutting elements is distributed between two or more blades, with the fixed cutting elements positioned rotationally after the rolling cutting element relative to a rotational direction of the drill bit such that the fixed cutting profile of the fixed cutting element(s) rotationally overlaps the rolling cutting profile of the rolling cutting element. The rolling cutting element on the first blade, for example, degrades the formation material, and the fixed cutting element on the second blade removes the degraded material. A rolling cutting element on the second blade degrades the formation material, and the fixed cutting element on the third blade removes the degraded material. In some embodiments, a fluid flow through the slot between the first blade and the second blade further dislodges or degrades the degraded material, allowing the fixed cutting element(s) to remove the degraded material more easily. In some embodiments, a hydraulic nozzle in or proximate to the slot directs fluid flow at the degraded material between the rolling cutting element and the fixed cutting element(s) of the set of cutting elements. In some embodiments, the hydraulic nozzle is positioned in the slot rotationally between the rolling cutting elements of different sets of cutting elements. In some embodiments, the hydraulic nozzle is positioned in the slot rotationally between the rolling cutting element (on a first blade) and the fixed cutting element (on a second blade) of a set.

In some embodiments, the set of cutting elements has no intervening features therebetween.

In some embodiments, the rolling cutting element and the fixed cutting elements are immediately rotationally adjacent to one another such that the fixed cutting profile of the fixed cutting element(s) rotationally overlaps the rolling cutting profile of the rolling cutting element. In some embodiments, the rolling cutting element and the fixed cutting elements are rotationally adjacent to one another with a slot therebetween such that the fixed cutting profile of the fixed cutting element(s) 738 rotationally overlaps the rolling cutting profile of the rolling cutting element 732. In some embodiments the drill bit includes an additional feature or components rotationally between the rolling cutting element and the fixed cutting element(s) of the set. In at least one embodiment, the drill bit includes at least one depth limiter that limits a DOC of the fixed cutting elements and/or a depth of degradation or damage from the rolling cutting elements. Additional features may further include nozzles, jets, gauge pads and other wear-resistance components, or other elements of the drill bit positioned on the outward-facing surface of the blades.

In some embodiments, a set of cutting elements according to any embodiment described herein is positioned on a nose region of the drill bit. In some embodiments, the set is positioned on a single blade. In some embodiments, the set is distributed between a plurality of blades with the fixed cutting elements rotationally after the rolling cutting element. In some embodiments, a set is positioned on a shoulder region of the drill bit. In some embodiments, a set is positioned on a gauge surface of the drill bit. In some embodiments, a set is positioned on a cone region of the drill bit. In some embodiments, the cone region includes fixed cutting elements and lacks a rolling cutting element.

As described herein, in some embodiments, the ridge height varies along the length of the rolling cutting element, allowing the rolling cutting element to contact and degrade a curved section of the formation material. In particular, a rolling cutting element positioned on a nose region or shoulder region of a drill bit may use a varying ridge height to substantially match a curvature of the blade of the drill bit at that location on the cutting profile.

In some embodiments, a plurality of sets of cutting elements overlap with one another to provide a substantially continuous degradation and removal of formation material. In some embodiments, the rolling cutting profile of each rolling cutting element overlaps substantially continuously along at least a portion of the cutting profile of the drill bit. In some embodiments, the rolling cutting profile of each rolling cutting element overlaps substantially continuously along at least a nose region and a shoulder region of the cutting profile of the drill bit.

In at least some embodiments according to the present disclosure, a drill bit with sets of cutting elements including a rolling cutting element rotationally before a plurality of fixed cutting elements allows for higher ROP and/or lower WOB and TOB while drilling some formations.

The present disclosure relates to systems and methods for drilling in an earth formation according to any of the following:

Clause 1. A drill bit comprising: a bit body with a rotational axis in a longitudinal direction; at least one blade coupled to the bit body with an outward surface; a rolling cutting element positioned on the outward surface; and a fixed cutting element positioned with a fixed cutting profile at least partially rotationally overlapping with a rolling cutting profile of the rolling cutting element.

Clause 2. The drill bit of clause 1, wherein the rolling cutting element has a cutting element axis in plane with a radial plane of the rotational axis.

Clause 3. The drill bit of clause 1, wherein the fixed cutting element is positioned on the outward surface.

Clause 4. The drill bit of clause 1, wherein the at least one blade is a first blade, and the fixed cutting element is positioned on a second blade.

Clause 5. The drill bit of clause 1, wherein the rolling cutting profile has a greater length relative to a rotational direction than the fixed cutting profile.

Clause 6. The drill bit of clause 1, wherein the fixed cutting element is a first fixed cutting element of a plurality of fixed cutting elements, and the fixed cutting profile of the plurality of fixed cutting elements at least partially rotationally overlaps with the rolling cutting profile of the rolling cutting element.

Clause 7. The drill bit of clause 6, wherein the rolling cutting profile has a length relative to a rotational direction no less than the fixed cutting profile.

Clause 8. The drill bit of clause 1, wherein the fixed cutting element is rotationally adjacent to the rolling cutting element.

Clause 9. The drill bit of clause 8, wherein the fixed cutting element is rotationally adjacent to the rolling cutting element with no intervening features therebetween on the outward surface.

Clause 10. The drill bit of clause 1, wherein the fixed cutting element is a shear cutting element.

Clause 11. The drill bit of clause 1, wherein the fixed cutting element is an apexed cutting element.

Clause 12. The drill bit of clause 1, wherein the fixed cutting element is a spinning cutting element.

Clause 13. The drill bit of clause 1, wherein the rolling cutting element includes ridges.

Clause 14. The drill bit of clause 13, wherein the ridges have a varying ridge height along at least a portion of the rolling cutting element.

Clause 15. The drill bit of clause 1, wherein a working surface of the rolling cutting element is an ultrahard material.

Clause 16. A drill bit comprising: a bit body with a rotational axis in a longitudinal direction; a first blade coupled to the bit body with a first outward surface; a first rolling cutting element having a cutting element axis in plane with a first radial plane of the rotational axis positioned on the first outward surface; a first fixed cutting element positioned with a first fixed cutting profile at least partially rotationally overlapping with a first rolling cutting profile of the first rolling cutting element; a second blade coupled to the bit body with a second outward surface; a second rolling cutting element having a cutting element axis in plane with a second radial plane of the rotational axis positioned on the second outward surface; and a second fixed cutting element positioned with a second fixed cutting profile at least partially rotationally overlapping with a second rolling cutting profile of the second rolling cutting element, wherein the first rolling cutting profile rotationally overlaps the second rolling cutting profile.

Clause 17. The drill bit of clause 16, further comprising a hydraulic nozzle oriented to provide a fluid flow between the first blade and the second blade.

Clause 18. The drill bit of clause 17, wherein the hydraulic nozzle is positioned rotationally between the first rolling cutting element and the second rolling cutting element.

Clause 19. The drill bit of clause 17, wherein the hydraulic nozzle is positioned rotationally between the first fixed cutting element and the second fixed cutting element.

Clause 20. A drill bit comprising: a bit body with a rotational axis in a longitudinal direction; a first blade coupled to the bit body with a first outward surface; a second blade coupled to the bit body with a second outward surface; a third blade coupled to the bit body with a third outward surface; a first rolling cutting element having a cutting element axis in plane with a first radial plane of the rotational axis positioned on the first outward surface; a first fixed cutting element positioned with a first fixed cutting profile at least partially rotationally overlapping with a first rolling cutting profile of the first rolling cutting element, the first fixed cutting element positioned on the second outward surface; a second rolling cutting element having a cutting element axis in plane with a second radial plane of the rotational axis positioned on the second outward surface; and a second fixed cutting element positioned with a second fixed cutting profile at least partially rotationally overlapping with a second rolling cutting profile of the second rolling cutting element, the second fixed cutting element positioned on the third outward surface, wherein the first rolling cutting profile rotationally overlaps the second rolling cutting profile.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A drill bit comprising:

a bit body with a rotational axis in a longitudinal direction;

at least one blade coupled to the bit body with an outward surface;

a rolling cutting element positioned on the outward surface, the rolling cutting element including ridges separated by a trough in an axial direction of a cutting element axis of the rolling cutting element; and a fixed cutting element positioned with a fixed cutting profile at least partially rotationally overlapping with a rolling cutting profile of the rolling cutting element.

2. The drill bit of claim 1, wherein the cutting element axis of the rolling cutting element is in plane with a radial plane of the rotational axis.

3. The drill bit of claim 1, wherein the fixed cutting element is positioned on the outward surface.

4. The drill bit of claim 1, wherein the at least one blade is a first blade, and the fixed cutting element is positioned on a second blade.

5. The drill bit of claim 1, wherein the rolling cutting profile has a greater length relative to a cutting element axis than the fixed cutting profile.

6. The drill bit of claim 1, wherein the fixed cutting element is a first fixed cutting element of a plurality of fixed cutting elements, and the fixed cutting profile of the plurality of fixed cutting elements at least partially rotationally overlaps with the rolling cutting profile of the rolling cutting element.

7. The drill bit of claim 6, wherein the rolling cutting profile has a length relative to a cutting element axis no less than the fixed cutting profile.

8. The drill bit of claim 1, wherein the fixed cutting element is rotationally adjacent to the rolling cutting element.

9. The drill bit of claim 8, wherein the fixed cutting element is rotationally adjacent to the rolling cutting element with no intervening features therebetween on the outward surface.

10. The drill bit of claim 1, wherein the fixed cutting element is a shear cutting element.

11. The drill bit of claim 1, wherein the fixed cutting element is an apexed cutting element.

12. The drill bit of claim 1, wherein the fixed cutting element is a spinning cutting element.

13. The drill bit of claim 1, wherein the fixed cutting element profile has a prominence greater than a ridge height of the ridges.

14. The drill bit of claim 1, wherein the ridges have a varying ridge height along at least a portion of the rolling cutting element.

15. The drill bit of claim 1, wherein a working surface of the rolling cutting element is an ultrahard material.

16. A drill bit comprising:

a bit body with a rotational axis in a longitudinal direction;

a first blade coupled to the bit body with a first outward surface;

a first rolling cutting element having a cutting element axis in plane with a first radial plane of the rotational axis positioned on the first outward surface, the first rolling cutting element including ridges separated by a trough in an axial direction of the cutting element axis of the first rolling cutting element;

a first fixed cutting element positioned with a first fixed cutting profile at least partially rotationally overlapping with a first rolling cutting profile of the first rolling cutting element;

a second blade coupled to the bit body with a second outward surface;

a second rolling cutting element having a cutting element axis in plane with a second radial plane of the rotational axis positioned on the second outward surface, the second rolling cutting element including ridges separated by a trough in an axial direction of the cutting element axis of the second rolling cutting element; and a second fixed cutting element positioned with a second fixed cutting profile at least partially rotationally overlapping with a second rolling cutting profile of the second rolling cutting element, wherein the first rolling cutting profile rotationally overlaps the second rolling cutting profile.

17. The drill bit of claim 16, further comprising a hydraulic nozzle oriented to provide a fluid flow between the first blade and the second blade.

18. The drill bit of claim 17, wherein the hydraulic nozzle is positioned rotationally between the first rolling cutting element and the second rolling cutting element.

19. The drill bit of claim 17, wherein the hydraulic nozzle is positioned rotationally between the first fixed cutting element and the second fixed cutting element.

20. A drill bit comprising:

a bit body with a rotational axis in a longitudinal direction;

a first blade coupled to the bit body with a first outward surface;

a second blade coupled to the bit body with a second outward surface;

a third blade coupled to the bit body with a third outward surface;

a first rolling cutting element having a cutting element axis in plane with a first radial plane of the rotational axis positioned on the first outward surface, the first rolling cutting element including ridges separated by a trough in an axial direction of the cutting element axis of the first rolling cutting element;

a first fixed cutting element positioned with a first fixed cutting profile at least partially rotationally overlapping with a first rolling cutting profile of the first rolling cutting element, the first fixed cutting element positioned on the second outward surface;

a second rolling cutting element having a cutting element axis in plane with a second radial plane of the rotational axis positioned on the second outward surface, the second rolling cutting element including ridges separated by a trough in an axial direction of the cutting element axis of the second rolling cutting element; and a second fixed cutting element positioned with a second fixed cutting profile at least partially rotationally overlapping with a second rolling cutting profile of the second rolling cutting element, the second fixed cutting element positioned on the third outward surface, wherein the first rolling cutting profile rotationally overlaps the second rolling cutting profile.

* * * * *